United States Patent [19]

McGaha et al.

[11] 4,166,221

[45] Aug. 28, 1979

[54] OVERSPEED PROTECTION CONTROLLER EMPLOYING INTERCEPTOR VALVE SPEED CONTROL

[75] Inventors: Patrick L. McGaha, Pocopson; Millard F. Smith, West Town Township, Allegheny County, both of Pa.

[73] Assignee: Westinghouse Electric Corp., Pittsburgh, Pa.

[21] Appl. No.: 876,397

[22] Filed: Feb. 9, 1978

[51] Int. Cl.[2] ..... F01K 13/02

[52] U.S. Cl. ..... 290/40 R; 60/646; 60/652

[58] Field of Search ..... 290/2, 40 R, 40 B, 40 C; 60/646, 652, 663

[56] References Cited

U.S. PATENT DOCUMENTS

| | | | |
|---|---|---|---|
| 3,601,617 | 8/1971 | De Mello et al. | 290/40 C |
| 3,643,437 | 2/1972 | Birnbaum et al. | 60/646 |
| 3,956,637 | 5/1976 | Aotsu et al. | 290/40 R |
| 3,998,058 | 12/1976 | Park | 60/652 |
| 3,999,787 | 12/1976 | Park | 290/40 R |

*Primary Examiner*—J. V. Truhe
*Assistant Examiner*—W. E. Duncanson, Jr.
*Attorney, Agent, or Firm*—W. E. Zitelli

[57] ABSTRACT

An overspeed protection controller (OPC) which is incorporated as part of a turbine speed/load control system for the purposes of controlling the monitored speed of a steam turbine at a first predetermined speed valve subsequent to an OPC activation is disclosed. The governor and interceptor valves of the steam turbine are positioned controlled by a set of electrohydraulically operated valve position servo systems. The OPC provides for rapid hydraulic closure of each valve when activated by either a detection of an interruption of generated electrical power flow to a power system load when the generated electrical power is greater than a predetermined value or the detection of the monitored turbine speed being greater than a second predetermined speed value. The rapid closure of the valves results in an interruption of steam flow to the high and lower pressure turbine sections of the turbine system which causes steam energy to be trapped in the reheater which is disposed between the turbine sections. The OPC is deactivated subsequent a predetermined time interval after the detection of generated power interruption when the monitored turbine speed is no longer greater than the second predetermined speed value. In response to the deactivation, the OPC controls the rotating speed of the turbine by positioning the interceptor valves to admit steam from the reheater to the lower pressure turbine sections in accordance with a continuous function based on the difference between the monitored turbine speed and the first predetermined speed value. Thus, the trapped steam energy in the reheater is utilized for keeping the turbine at the first predetermined speed value to permit rapid resynchronization of the turbine system with the power system load.

10 Claims, 8 Drawing Figures

OVERSPEED PROTECTION CONTROLLER EMPLOYING INTERCEPTOR VALVE SPEED CONTROL

BACKGROUND OF THE INVENTION

The invention relates to steam turbine system overspeed protection controllers in general, and more particularly, to a system for using the stored steam energy contained in the reheater of a steam turbine system following an overspeed protection controller activation to sustain the rotating speed of the turbine at synchronous speed providing for rapid resynchronization.

A typical steam turbine system is shown in FIG. 1. A conventional steam turbine is comprised of a high pressure turbine section 10 and one or more low pressure turbine sections 12 which are generally mechanically coupled to a common shaft 14 for driving an electrical generator 16. The electrical generator 16 is used to supply electrical power to a load 18. Steam is admitted to the input of the high pressure turbine section 10 from a steam source 20 and is usually regulated by one or more governor valves 22. The steam exiting from the high pressure turbine section 10 is reheated by a reheater 24 prior to being supplied downstream to the input to the one or more low pressure turbine sections 12. One or more interceptor valves 26 may be used to interrupt the flow of steam between the input of the low pressure turbine sections 12 and the reheater 24. Steam exhausting from the one or more low pressure turbine sections 12 may be provided to a condenser 28.

The mechanical power which is developed in the high pressure and low pressure turbine sections 10 and 12, respectively, mechanically drives the electrical generator 16 which, in turn, converts the mechanical power to electrical power to be supplied to the electrical load 18. Since the coupling between the electrical generator 16 and electric load 18 is very sensitive to the frequencies of the two systems, a breaker 30 is provided to connect the electrical generator 16 to the load 18 only at times when the frequency of the electrical power generated by the generator 16 is synchronous according to a predetermined phase relationship to that of the load 18. Typically, power plant auxiliaries 32 such as electrical motors, electrical pumps, lighting, etc., are usually driven by the electrical generator 16 independent of the position of the breaker 30. Electrical power is supplied to the plant auxiliaries 32 whether the breaker 30 is open or closed to the power system load 18.

A speed/load controller 36 is generally used to govern the speed and load operation of the turbine system by controlling the position of the one or more governor valves utilizing a conventional governor valve hydraulic actuator type system 40 in accordance with measured parameters such as speed SPD, megawatt output MW, and breaker contact status BR. Examples of a speed/load controller 36 which is used for controlling the speed and load of a steam turbine system are disclosed in U.S. Pat. Nos. 3,878,401 and 3,934,128. The mechanical rotating speed of the turbine is generally monitored using a notched wheel 33, which is located on the turbine shaft 14 and rotated at the same angular velocity thereby, and a magnetic speed pickup 34 which is disposed adjacent to the periphery of the wheel 33 to supply a signal SPD representative of the turbine speed to the controller 36. In addition, a signal MW is supplied to the controller 36 from a typical megawatt transducer 38, which monitors the electrical power produced by the generator 16. And accordingly, a signal representative of the status of the breaker contacts 30 is supplied to the controller 36 over the signal line denoted as BR.

The breaker contacts 30 are also operative to disconnect the power steam turbine system from the power system load 18 at times when an electrical fault of significance is detected. It is understood that should the breaker 30 disconnect the steam turbine system from the power system load 18 at times when electrical power is being supplied thereto, the mechanical power produced by the steam turbine system will cause a mechanical overspeed to occur. For these reasons, an overspeed protection controller (OPC) 42 is provided to detect such an overspeed event and rapidly reduce the mechanical power produced by the turbine sections 10 and 12 by interrupting steam admitted thereto. Typical OPC systems are disclosed in U.S. Pat. Nos. 3,643,437; 3,826,095; and 3,826,094. This type of OPC unit (see block 42 in FIG. 1) monitors the SPD, MW, and BR signals and activates an overspeed protection control in accordance with predetermined logic conditions such as that shown in FIG. 2, for example.

Referring to FIG. 2, there exists at least two conditions which may trigger an overspeed protection control. One condition is that the SPD signal is greater than some predetermined value, normally 103% of synchronous speed. Another condition may be the interruption of the flow of electrical power from the generator 16 to the power system load 18 by opening the breaker 30 (denoted as $\overline{BR}$) with the stipulation that the megawatts (MW) produced at the time of interruption is greater than some predetermined value, usually approximately 30%. These two conditions may be OR'ed, as shown in FIG. 2, to trigger an overspeed protection control (OPC). An overspeed protection control consists primarily of the events of energizing a number of OPC solenoids to operate hydraulic dump valves located in the governor valve and interceptor valve hydraulic actuators, 40 and 41, respectively. These dump valves when actuated operate to dump the fluid from the hydraulic actuators to drains, 44 and 46, as shown in FIG. 1, and simultaneously interrupt the hydraulic fluid supply to the governor valve and interceptor valve actuators. The governor valve 22 and interceptor valve 26 respond by immediately closing. According to the logic of FIG. 2, in order to deactivate the dump valves by deenergizing the OPC solenoids, a time delay is effected after the breaker 30 has opened which may be adjusted to some predetermined time delay interval, say 1 to 10 seconds, for example. At the end of this time delay interval should the speed be below the predetermined value typically chosen at 103% synchronous speed, the overspeed protection control will be deactivated, thereby deenergizing the OPC solenoids and causing the dump valves to no longer be in the state to dump fluid to the drains 44 and 46. During this same operation the hydraulic fluid will be resupplied to the governor valve and interceptor valve hydraulic actuators. In some systems, the interceptor valves 26 will respond to the resupply of hydraulic fluid to the hydraulic actuators by immediately reopening to its full open position. In these same systems, the governor valves 22 will remain under the control of the speed/load controller 36 after the hydraulic fluid has been resupplied to the hydraulic actuators 40. With the type of overspeed protection control described above, one might expect the turbine rotating speed to respond as that shown by the solid line curve 50 in FIG. 3 for the case when the electrical generator 16 is supplying close to 100% rated electrical power to the power system load 18 and the breaker contacts 30 are opened.

Referring to FIG. 3, the time mark $t_0$ on the abscissa of the graph designates a point in time at which the breakers 30 of FIG. 1 are opened. Since the electrical power produced by the generator 16 just prior to the time mark $t_0$ was assumed near rated electrical power output, an OPC activation is initiated concurrently with the opening of the breaker contacts 30. The dumping of the hydraulic fluid as a result of the OPC activation forces the governor valves 22 and interceptor valves 26 to close usually within a fraction of a second. However, as shown by curve 50 in FIG. 3, the speed is anticipated to rise beyond synchronous speed subsequent to the time mark $t_0$ due primarily to the amount of inertia built up in the turbine system. With the interruption of steam input to the turbine sections 10 and 12, damping forces such as windage and friction losses in the turbine system cause the speed of the turbine to decay back down to some predetermined value, such as 103% which is shown at the time mark $t_1$ in FIG. 3. The expected time interval between $t_0$ and $t_1$ is on the order of 50 to 60 seconds, but may vary from turbine to turbine.

At the time $t_1$, the OPC signal is deactivated in accordance with the logic shown in FIG. 2 thus allowing for the interceptor valves 26 to be operated to their wide open position and the steam which has been stored in the reheater 24 during the OPC activation is admitted through the interceptor valves 26 to the low pressure turbine sections 12. The rotating speed of the turbine is then again increased greater than the 103% synchronous speed value which causes another activation of the overspeed protection control as controlled by the logic of FIG. 2. These activations and deactivations of the overspeed protection control will continue to occur, see times $t_2$, $t_3$ and $t_4$ of FIG. 3 until substantial amount of the steam energy has been dissipated from the reheater 24. A typical dissipation curve is shown by the dashed line 52 in FIG. 3. It has been estimated that the number of speed oscillations shown typically between the time intervals depicted in the graph of FIG. 3 may amount to as many as 10 or 12 over a time period of approximately 10 to 12 minutes.

In the types of OPC systems just described, it is unlikely that resynchronization of the turbine system to the load can occur until the frequency oscillations of FIG. 3 have stopped. It is evident then, in order to have rapid resynchronization, these oscillations should be eliminated while still providing overspeed protection to the turbine system. An overspeed protection controller which could provide a rotating speed response curve such as that depicted by the dotted line 54 in FIG. 3 is desired. In this example, protection against overspeed is provided immediately following the opening of the breaker 30 at time $t_0$, but at time $t_1$ no reactivation of the overspeed protection control is performed and speed is thereafter controlled at a synchronous speed value. If the rotating speed could be controlled in this manner, resynchronization to the power system load could be performed then at any time subsequent to $t_1$. Even for the case when resynchronization is not required, the electrical power supply to the plant auxiliaries 32 will be maintained at a near fixed frequency level after the frequency excursion between times $t_0$ and $t_1$ as a result of the opening of breaker contacts 30.

SUMMARY OF THE INVENTION

In accordance with the present invention, an improved overspeed protection controller (OPC) is incorporated as part of a turbine speed/load control system for the purposes of controlling the turbine speed at a first predetermined speed value subsequent an OPC activation. More specifically, the OPC provides an electrohydraulic means which is operative to rapidly close each of the governor and interceptor valves of the turbine speed/load control system when activated by either a detection of the generator main breaker 30 opening during a time when the generated electrical power of the turbine system is greater than a predetermined value of electrical power or the detection of the monitored turbine speed being greater than a second predetermined speed value. Consequently, the steam flow admitted to the high and low pressure turbine sections is interrupted and steam energy is trapped in the reheater which is coupled between the high and low pressure turbine sections. Accordingly, the electrohydraulic means is deactivated at a time which is subsequent a predetermined time interval immediately following the detection of the generator main breaker opening when the monitored speed is no longer greater than the second predetermined speed value. Additionally, the improved OPC provides a control means which is operative in response to the deactivation of the electrohydraulic means to control the rotating speed of the turbine by positioning the interceptor valves to admit steam to the lower pressure turbine sections in accordance with a continuous function based on the difference between the monitored turbine speed and the first predetermined speed value, whereby the trapped steam energy of the reheater is utilized for keeping the turbine at the first predetermined speed value to permit rapid resynchronization of the turbine system to the power system load.

DESCRIPTION OF THE PREFERRED EMBODIMENTS

Figure 1:
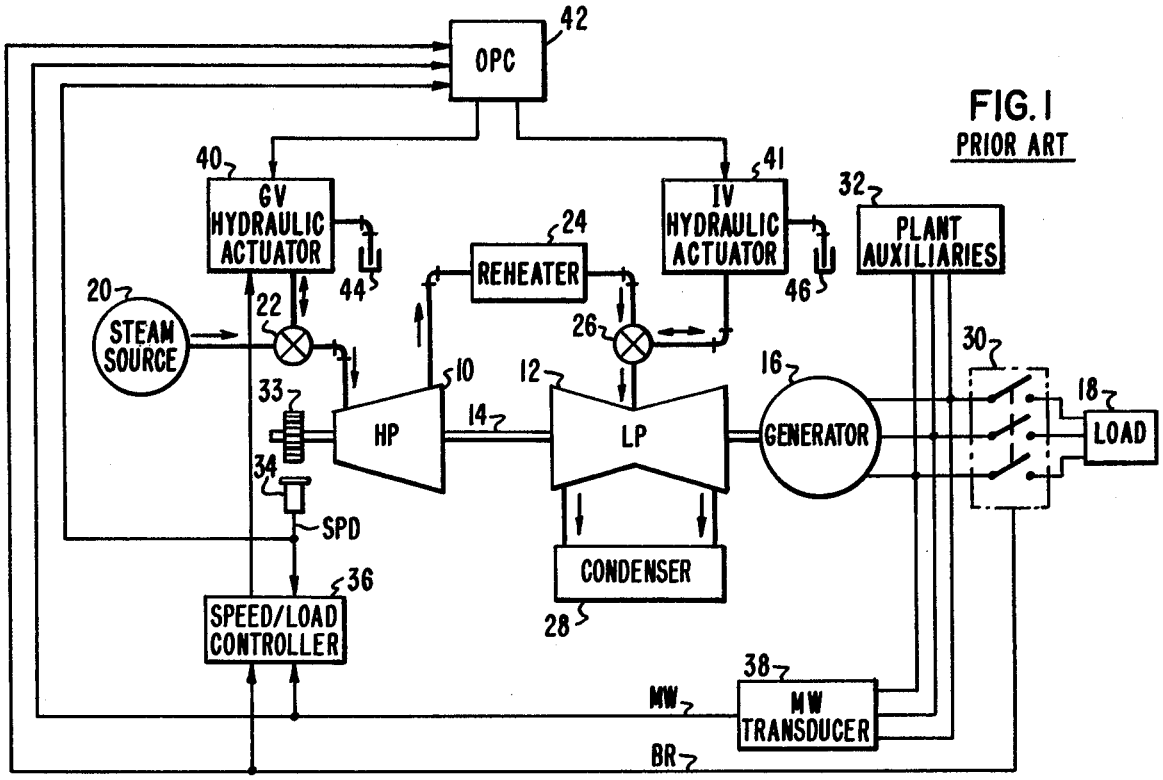
FIG. 1 PRIOR ART
FIG. 1 is a block diagram schematic of a typical turbine system.
Figure 2:
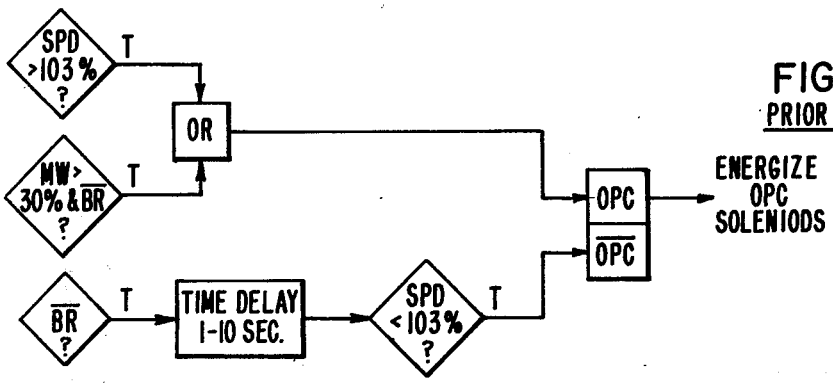
FIG. 2 PRIOR ART
FIG. 2 is a logic diagram for an overspeed protection controller (OPC) suitable for use in the turbine system of FIG. 1.
Figure 3:
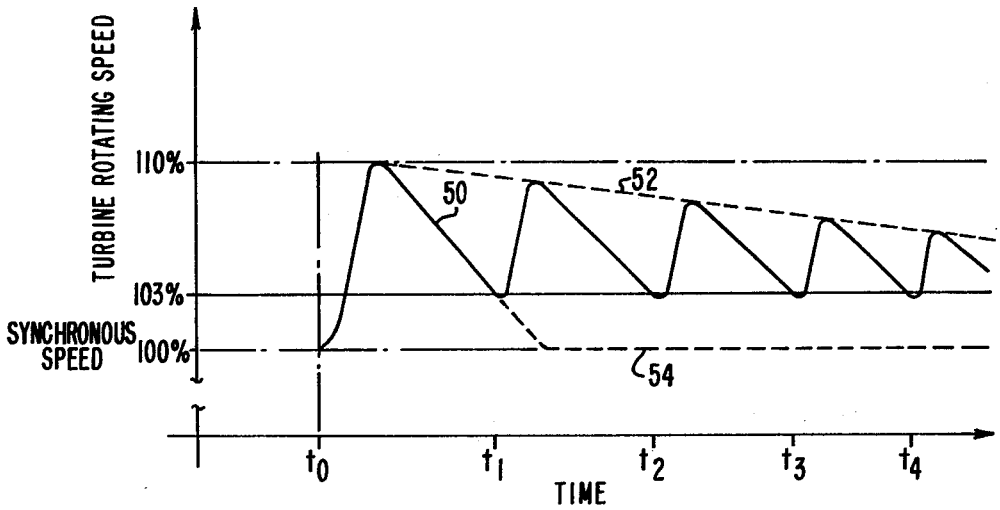
FIG. 3 is a graph depicting turbine rotating speed with respect to time subsequent to an OPC activation.
Figure 4:
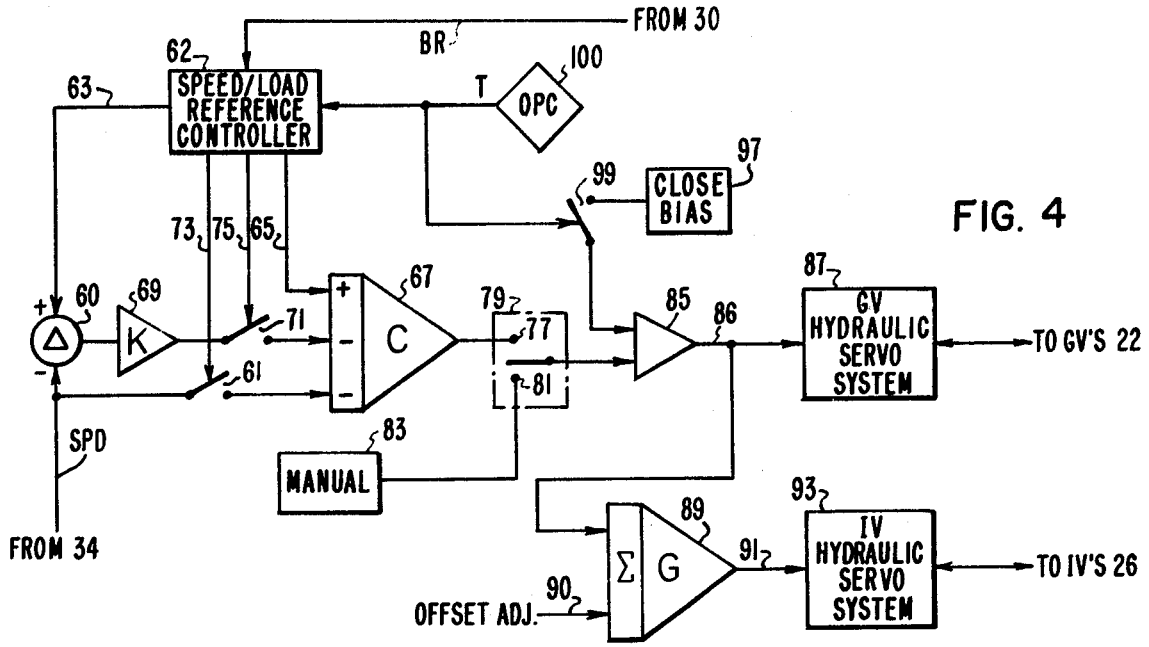
FIG. 4 is a block diagram schematic of one embodiment of an OPC which functions in accordance with the principles of the present invention.

Referring to FIG. 4, a portion of the improved overspeed protection control is incorporated into the speed/load controller 36 (see FIG. 1). The speed signal SPD is coupled to the minus input of a difference function 60 and to one position of a single-pole-single-throw (SPST) switch 61. This signal SPD is representative of the actual rotating speed of the turbine. A speed/load demand reference controller 62 provides a signal 63 to the positive input of the difference function 60. The signal 63 is generally a fixed value representative of the synchronous speed of the turbine system. The speed/-load demand reference controller 62 also monitors the main generator breaker 30 of the turbine system (see FIG. 1) and additionally monitors the digital demand status 100 of the overspeed protection control which is normally derived from the logic as shown in FIG. 2. The reference controller 62 generates a speed and load reference control signal 65 to the positive input of a closed-loop controller 67. The speed error output of the difference function 60 is amplified by an amplifier 69 which has a gain representative of the regulation factor K which is normally selected such that at 5% speed greater than synchronous speed a signal is produced at the output of the amplifier 69 representative of 100% load. The output signal of amplifier 69 is connected to a one position of second SPST switch 71. The other position of the switches 61 and 71 are connected to negative inputs of the controller 67. The switches 61 and 71 are controlled by the speed/load reference controller 62 using signal lines 73 and 75, respectively.

The output of the closed-loop controller 67 is connected to one switch position 77 of the single-pole-double-throw (SPDT) switching function 79. A second position of switch 79 is coupled to a manual valve position controller 83 which is generally associated with the speed and load controller 36. The SPDT switching function 79 provides additionally for a bumpless transfer from the automatic closed-loop controller 67 to the manual controller 83 according to that which is presently well known in the art. For a more detailed description of this bumpless transfer and manual type valve position controller refer to U.S. Pat. No. 3,741,346 issued to Braytenbah on June 26, 1973. The pole of the switching function 79 is coupled to the input of a buffer amplifying function 85. It is understood that the depiction shown in FIG. 4 is greatly simplified much to emphasize those parts connected with the invention and it is further understood that other functions such as control of load using a feedback load signal or a valve management feedforward control or an impulse pressure chamber closed-loop control may also be performed without deviating from the scope of the invention.

The output of the amplifier function 85 is the setpoint input 86 to a set of one or more governor valve hydraulic servo systems 87 which function to position the corresponding governor valves 22 to control the admission of steam from the steam source 20 to the high pressure turbine 10 (refer to FIG. 1). A more detailed description of a typical hydraulic servo system will be described hereinbelow in connection with FIG. 5. The governor valve servo system setpoints 86 are additionally provided to an amplifying function 89 which has an adjustable offset signal 90 additionally coupled as an input. The amplifying function 89 multiplies the setpoint signal 86 by some suitable gain G, thus producing an output 91 which is the setpoint 86 offset by signal 90 and multiplied by the gain G. The signal 91 is the setpoints for a set of interceptor valve hydraulic servo systems 93. These interceptor valve hydraulic servo systems correspondingly function with their associated interceptor valves 26 to position the interceptor valves 26 in accordance with the setpoints provided by 91. This will be described in more detail in connection with the description of FIG. 5 below. The positioning of the valves 26 governs the steam admission from the reheater 24 to the low pressure turbine sections 12 similar to that which is shown in FIG. 1. In addition, a closed bias is generated by function 97 and coupled through the SPST switch function 99 to the amplifying function 85. The switch function 99 is energized to close in conjunction with the overspeed protection control demand status signal 100.

Figure 5:
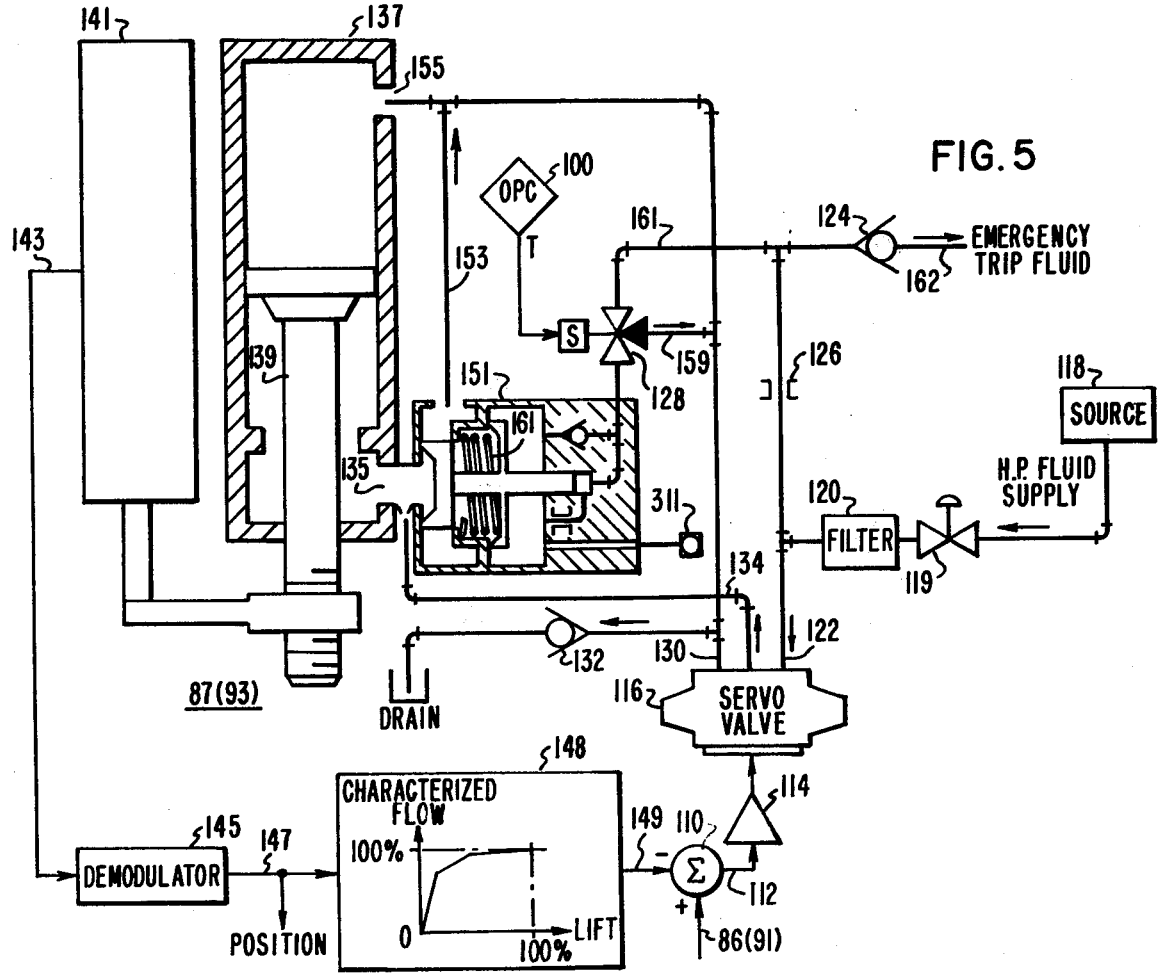
FIG. 5 is an electrohydraulic schematic of a valve positioning servo controller suitable for use in the preferred embodiments.

Depicted in FIG. 5 is a typical hydraulic servo system suitable for use as the governor valve hydraulic servo system 87 or interceptor valve hydraulic servo system 93 as shown in FIG. 4. Specifically, the setpoint reference signal 86 (91) is coupled to the positive input of a summing junction 110. A speed error signal 112 resulting from the function of the summing junction 110 is input to a servo amplifier 114 which may be implemented with any of the conventional type servo controllers such as a proportional controller, a proportional-plus-integral controller or a proportional-plus-integral-plus-derivative controller. The output of the servo amplifier 14 drives a hydraulic servo valve 116 normally of the type manufactured by Moog, Inc.

High pressure hydraulic fluid is generally provided to the hydraulic servo systems 87 and 93 from a source 118 through a conventional isolation valve 119 and a hydraulic fluid filter 120 to a supply port 122 of the servo valve 116. The high pressure hydraulic fluid downstream of the filter 120 is also provided to the upstream side of a check valve 124 through an orifice 126. The hydraulic fluid on the check valve side of the orifice is also provided to a solenoid valve 128. A drain port 130 of the servo valve 116 is coupled to the upstream side of a second check valve 132. The downstream end of the check valve 132 is coupled to a drain line. A fluid control port 134 of the servo valve 116 is coupled to a port 135 of an actuator 137. An operating piston 139 is disposed within the actuator to be movably positioned by the hydraulic fluid entering or leaving the port 135 of the actuator 137 as controlled by the servo valve 116. This operating piston 139 is conventionally linkaged proportionally to the stem of a steam admission valve such that the stem moves in accordance with the movement of the operating piston 139.

As the operating piston 139 moves upwards through the actuator 137, the steam admission valve stem moves in the direction to permit more steam to flow through the steam admission valve. A position measuring instrument 141, typically of the linear variable differential transformer (LVDT) type, is coupled to the operating piston 139 to generate a signal 143 which is representative of the opening position of the steam admission valve. Generally the signal 143, if being produced by a LVDT, is AC modulated an may be demodulated by a demodulator function 145 such that the position signal developed therefrom is consistent with the setpoint 86 (91). The lift position representative signal 147 developed from the demodulator 145 may be used directly as the feedback signal or negative input to the summing function 110 at times when the setpoint 86 (91) is representative of the position demand of the steam admission valve. In other cases, when the setpoint is representative of a flow demand of the steam admission valve, the position representative signal 147 may be characterized according to some function based on lift versus characterized flow similar to that which is shown in the block 148 of FIG. 5. The feedback signal or negative input to the summing junction 110 is then the output of the characterizer 148 and is consistent with a valve flow demand reference setpoint.

A dump valve 151 is also coupled to the port 135 of the actuator 137. This type of dump valve as depicted in FIG. 5 has the capacity to dump large volumes of hydraulic fluid from the actuator to a drain line 153 in a very short time period. The dump valve 151 may additionally supply hydraulic fluid through another port 155 of the actuator 137 to increase the movement of the operating piston in a direction to rapidly close the steam admission valves. The dump valve 151 functions in cooperation with the solenoid valve 128 such that when the solenoid valve 128 is energized by the overspeed protection control (OPC) demand signal 100 (see FIG. 2), the hydraulic fluid within the dump valve 151 which is holding the dump valve in a closed position is dumped to drain over the hydraulic line 159, thus relieving the pressurized force on a bias spring 161 contained within the dump valve 151. As a result, the bias spring 161 forces open the valve 151 to permit hydraulic fluid flow to pass from the port 135 of the hydraulic actuator 137 through the valve 151 to a dump line 153. In addition, the solenoid valve 128 may be hydraulically energized by the dumping of the hydraulic fluid in an emergency trip fluid line 162 as a result of a turbine trip condition. In this case hydraulic fluid is conducted from line 161 through the check valve 124 through line 162 to a drain (not shown in FIG. 5).

The operation of this embodiment will be now described in connection with the referenced FIGS. 1–6. Assuming initially that the turbine system is under load control at approximately a megawatt generation greater than some predetermined value, say for example 30% of rated electrical output of the power system, and a fault condition occurs to render the main generator breaker 30 to open. As a result of these conditions as shown in the logic of FIG. 2, an overspeed protection control demand signal (OPC) is generated. The state of the governor and interceptor valve position set point references is shown typically by the graph of FIG. 6. The curves 200 and 202 represent the setpoint references 86 and 91, respectively, as generated by the closed-loop controller 67 operating in cooperation with the speed/-load reference controller 62. Typically, the interceptor valves are wide open and the governor valves are partially or wide open at load conditions greater than 30%. Normally, under load control conditions, that is breaker 30 closed, the switch 71 (see FIG. 4) is closed allowing the conduction of the signal output of amplifier 69 to be coupled to the controller 67. Switch 61 is opened in this state.

Figure 6:
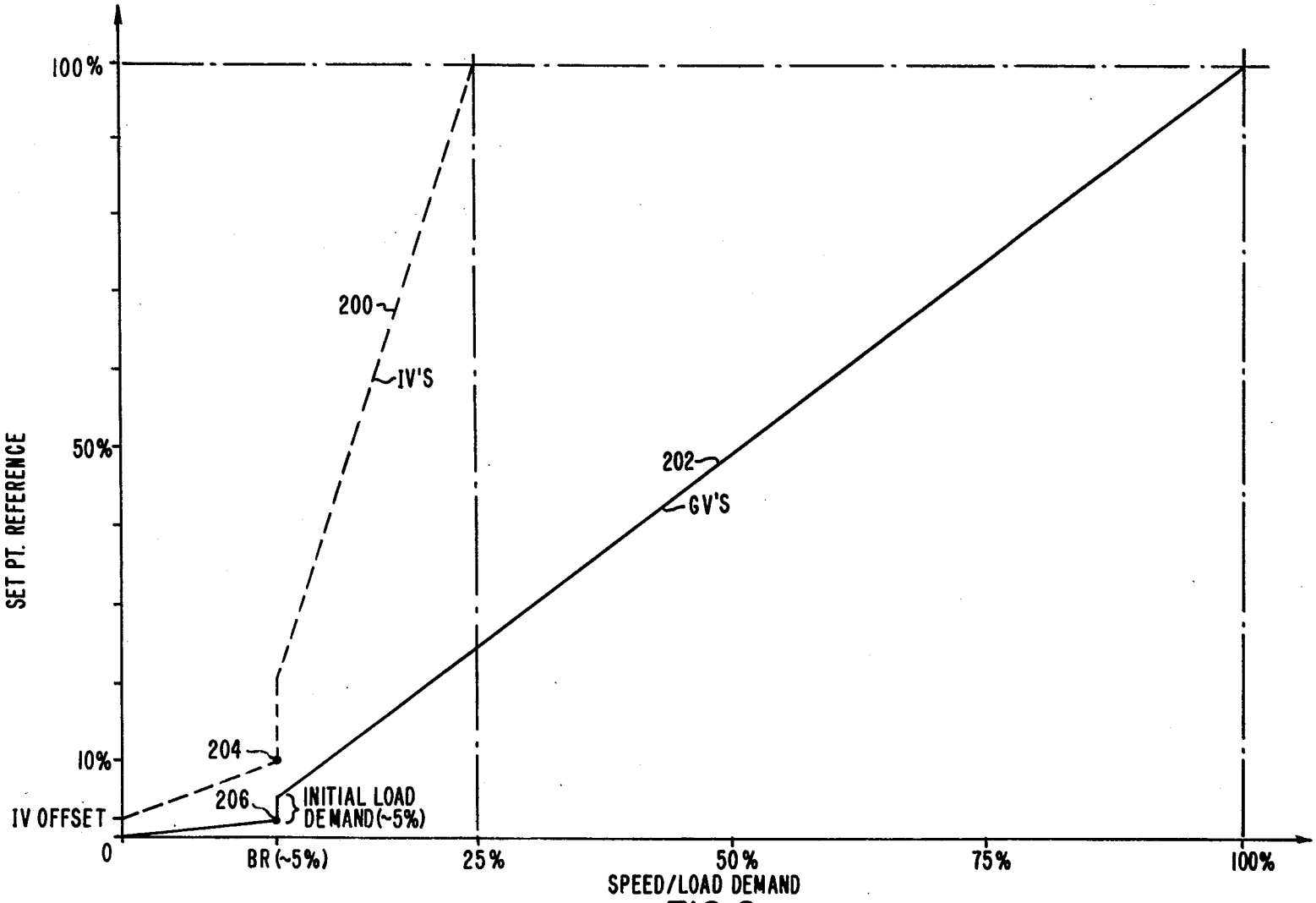
FIG. 6 is a graph depicting the governor and interceptor valve servo set point reference signals with respect to speed/load demand.

When the overspeed protection control demand signal (OPC) 100 is received by the speed/load reference controller 62, the switch position of switch 71 is open as controlled by line 75 and the switch 61 is closed as controlled by signal line 73. Simultaneously, the speed/-load reference signal 65 is brought to a value to set the positions of the interceptor valves and governor valves to those positions designated by points 204 and 206, respectively, as shown in FIG. 6. In addition and concurrent with the overspeed protection control demand initiation, the solenoid valves 128 are energized in each of the hydraulic servo system forcing open the dump valve 151 allowing hydraulic fluid to be dumped from the hydraulic actuator 137 causing the operating piston to rapidly fall in a direction to force the mechanical rapid closure of the steam admission valves. It is understood that one of these hydraulic servo systems is connected with each of the governor and interceptor valves controlling the steam admission to the high and low pressure turbine sections 10 and 12, respectively. Thus, an overspeed protection control demand signal 100 (refer to FIG. 5) will energize each of the solenoid valves 128 which will render the dump valves 151 activated to dump fluid from the hydraulic actuators 137 to rapidly close each of the governor and interceptor valves associated therewith.

With the main generator breaker 30 open, the electrical load on the generator is interrupted and an imbalance in mechanical to electrical power in the turbine system occurs simultaneous with the breaker opening causing the rotating speed of the turbine to increase. However, since the GV and IV steam admission valves are concurrently closed with the opening of the breaker 30, the mechanical power driving force is also interrupted. The turbine system normally increases in speed for a short time period as a result of inertia but thereafter will decay in speed as a result of windage and frictional losses (see that shown between times $t_0$ and $t_1$ in FIG. 3).

Referring to the logic of FIG. 2, after a predetermined adjustable time delay, say from 1 to 10 seconds, from the time at which the breaker 30 opened (denoted as $\overline{BR}$) the rotating speed signal SPD is monitored to detect a point in time at which the signal SPD falls below a signal level representative of a predetermined speed valve, typically set at 103% of synchronous speed. This condition is shown at time $t_1$ in FIG. 3. In conventional overspeed protection controller systems, the interceptor valves are hydraulically operated to a wide open position in response to the deenergization of the solenoid valve 128 which deactivates the dump valve 151 closing off the dumping of the hydraulic fluid from port 135 through dump line 153. In most interceptor valve hydraulic systems, a high pressure fluid line is conducted directly to the input port 135 through a conventional orifice, thereby permitting the valve to be stroked open immediately following the closure of the dump valve 151. As the interceptor valves are stroked open as a result of the deactivation of the dump valves 151, the steam trapped in the reheater 24 as a result of the rapid closure of the GV and IV steam admission valves will be conducted through the interceptor valves and provides sufficient mechanical power to again increase the speed beyond the 103% synchronous speed level. Thus, the oscillations as shown by the solid line curve 50 in FIG. 3 will be manifested until all of the steam energy in the reheater 24 is dissipated.

The preferred embodiment, however, does not permit the interceptor valves to be positioned wide open as a result of the deactivation of the dump valve 151. The OPC embodiment described above controls the position of the interceptor valves in accordance with the measured rotating speed of the turbine (i.e., signal SPD).

More specifically, the controller 67 is governed by the difference between a speed reference signal 65 provided by the reference controller 62 and the signal SPD which is representative of the actual rotating speed of the turbine. The controller 67 which may be typically a proportional controller controls the setpoints to the governor and interceptor valves over signal line 86 being coupled through switch position 77 of switch function 79 and through the amplifying function 85. As has been described above, the setpoint 86 to the governor valve hydraulic servo systems 87 is operated on by an offset and gain amplifier function 89 to produce the setpoints 91 for the interceptor valve hydraulic servo systems 93. Typical examples of the governor valve movement and interceptor valve setpoint references subsequent to a breaker opening are shown in FIG. 6 as points 206 and 204, respectively. The discontinuity shown in the curve 200 for the interceptor valves and 202 for the governor valves is caused by the speed/load reference controller 62 upon the occurrence of the closure of the breaker 30. This step flow demand as shown as the discontinuation of the curves of FIG. 6 is conventionally performed in turbine power system controls to compensate for any frequency deviations occurring upon breaker closure. The difference in gain between the curves 200 and 202 is caused by the gain G of the amplifier function 89 and is adjusted to be 4 for the example case shown in FIG. 6.

To summarize then, when the logical conditions exist to activate an overspeed protection control demand signal (OPC) 100 (see FIG. 2), the governor valves and interceptor valves are rapidly closed as a result of the energization of the solenoid relays 128 and activation of the dump valves 151 in each of the governor valve and interceptor valve hydraulic servo systems 87 and 89. With the valves closed, the rotating speed of the turbine will first increase due primarily to the inertia of the turbine system and then decay slowly according to the losses due to windage and friction of the mechanical parts. During the time the governor valves and interceptor valves are closed, steam energy is trapped in the reheater 24. Subsequent to the breaker opening and after a given predetermined time delay, the speed signal SPD is monitored to detect the point in time at which it falls below a predetermined speed valve say, for example, 103% synchronous speed. When this occurs, the overspeed protection control demand signal is deactivated, thus deenergizing each of the solenoid valves 128 in the governor valve and interceptor valve hydraulic servo systems which accordingly deactivate the dump valves 151 associated therewith to close off the port 135 in each of the actuators 137 contained therein.

Concurrent with the breaker 30 opening the speed/load reference controller 62 opens switch 71 and closes switch 61 associated with the controller 67. The speed error yielded by the difference between the signals 65 and SPD governs the controller 67 to provide setpoints to the governor valve and interceptor valve hydraulic servo systems. After the dump valves 151 in each of the hydraulic servo systems 87 and 93 are deactivated, the servo systems are operational to respond to their setpoints to position the valves. It is understood that the setpoints may either be position reference or flow demand reference related. Since the speed reference controller 62 sets its reference signal 65 substantially equal to the synchronous speed of the turbine, the valve positions or valve setpoint references will be controlled primarily about points 204 and 206 as shown along the curves 200 and 202, respectively, as shown in FIG. 6. The rotating speed of the turbine will respond to the speed control operaton as described above similar to that shown on the curve 54 in FIG. 3. At any time during the control of the turbine rotating speed at a valve utilizing the steam energy of the reheater by positioning the interceptor valves, the turbine system may be resynchronized (reconnected) to the power system load by closing the main generator breakers 30. After the breaker 30 is closed the interceptor valves and governor valves are controlled in accordance with the curves 200 and 202, respectively, shown in FIG. 6, for example.

Figure 7:
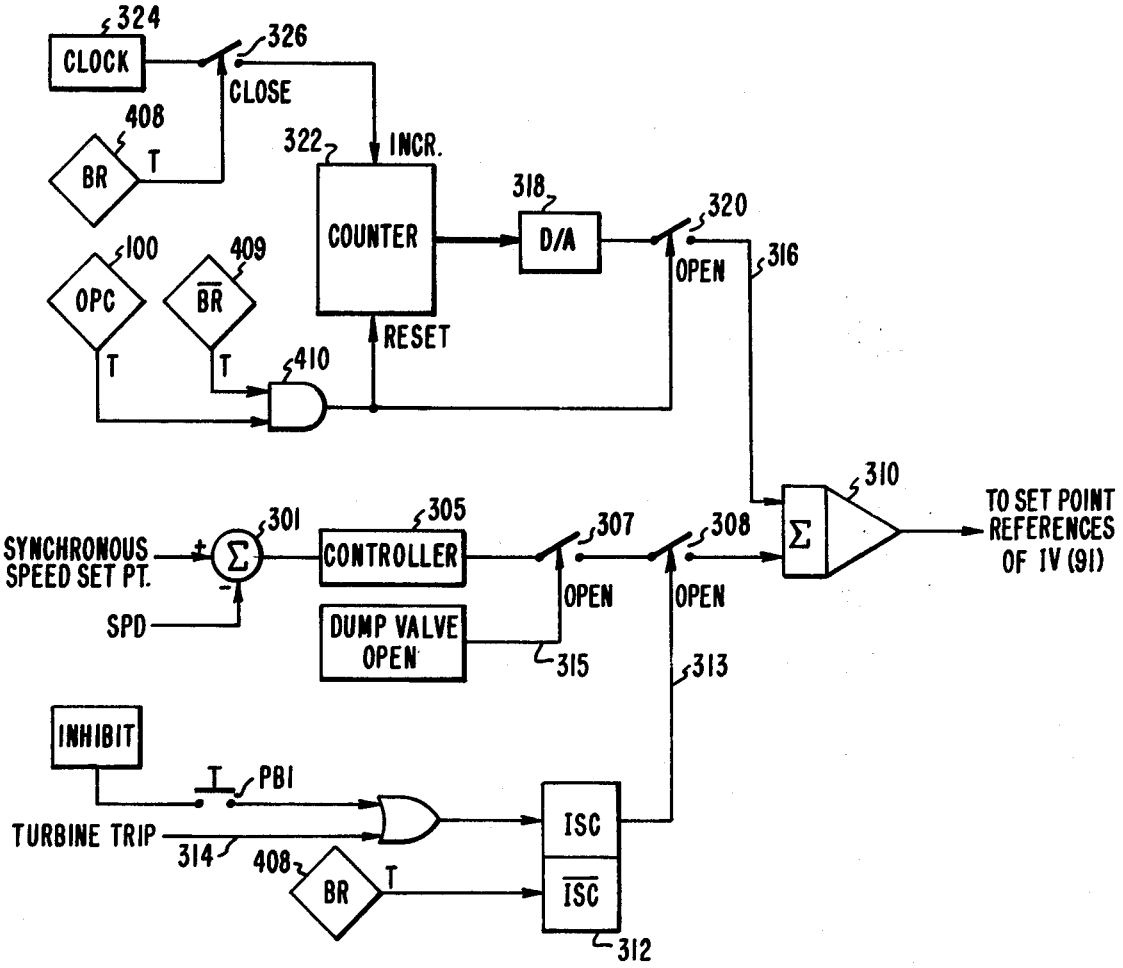
FIG. 7 is a block diagram schematic of an alternative embodiment of an OPC which functions in accordance with the principle of the invention.

An alternative embodiment which may be utilized to position the interceptor valves to control the rotating speed of the turbine at a synchronous speed valve after an OPC activation is shown in FIG. 7. Referring to FIG. 7, a predetermined fixed setpoint 300 which may be of the value representative of the synchronous speed of the turbine is coupled to the positive input of a summing junction 301. The negative input of the summing junction 301 is coupled to the measured speed signal SPD. The speed error resulting from the summing junction 301 is operated on by a controller 305. The output of the controller 305 is coupled through two cascaded single-pole-single-throw-switches 307 and 308 to one input of a buffer amplifier function 310. The first switch 307 is controlled in the open position to break the connection between the controller 305 and buffer amplifier function 310 at times when the dump valve 151 is open in accordance with an overspeed protection control demand signal (OPC) 100. The dump valve open logical signal 315 is developed from a pressure switch 311 which measures hydraulic pressure within the dump valve 151 of the hydraulic servo system as shown in FIG. 5. The second switch 308 is controlled in the open position as a result of a logical signal inhibit speed control ISC developed from a flip-flop function 312. The inhibit speed control (ISC) signal 313 may be triggered as a result of an operator initiation using push button PB1 or a turbine trip signal 314. Accordingly, the flip-flop 312 may be reset to the $\overline{ISC}$ state in conjunction with the closure of the main breaker 30. The control signal produced by controller 305 will only be conducted to the input of the buffer amplifier 310 at times when the speed control signal is not inhibited $\overline{ISC}$ and the dump valves 151 of the hydraulic servo systems 87 and 93 are closed.

A second signal 316 is provided to another input of the buffer amplifier function 310 from a conventional D/A converter 318 coupled through a single-pole-single-throw switch function 320. The digital-to-analog (D/A) converter 318 is responsive in a conventional manner to a digital counter 322. Clock pulses are provided to the counter 322 from a typical clock circuit 324 through a single-pole-single-throw switch function 326 which acts, at times, to interrupt the connection between the clock 324 and the counter 322. The output of the buffer amplifier function 310 is conducted to the interceptor valve hydraulic servo systems 93 using signal line 91. The amplifier function 89 as shown in FIG. 4 may be replaced by the system as shown in FIG. 7 with the exception that no coupling is made between the speed/load controller 36 and that system which is shown in FIG. 7.

Figure 8:
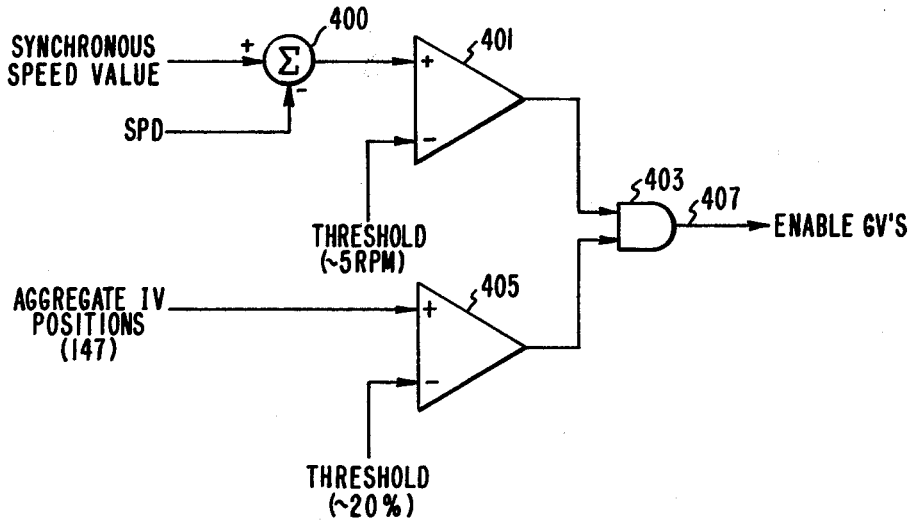
FIG. 8 is a circuit schematic of a governor valve controller which functions in coordination with the alternate embodiment of the OPC shown in FIG. 7.

In this alternative embodiment, an additional function shown in FIG. 8 may be added to the controller 36 to disable governor valve control according to a predetermined set of conditions. Referring to FIG. 8, a speed error is developed from the difference between a synchronous speed value and the measured speed value SPD utilizing the difference function 400. This speed error is coupled to the positive input of a comparator function 401. The negative input of the comparator 401 is adjusted to a threshold setting typically representative of 5 revolutions per minute (RPM). The output of the comparator function 401 is coupled to one input of an AND gate function 403. An aggregate of the IV position signals which are developed within the hydraulic servo systems (see FIG. 5, signal 147) is input to the minus input of another comparator function 405. The positive input of comparator function 405 is set at another threshold value representative of 20% interceptor valve position. The output of the second comparator 405 is coupled to the second input of the AND function 403. The output of the AND function 403 is used to inhibit control operation of the governor valves when false. The control point of coupling with the controller 36 is one input to the amplifier function 85. When signal 407 is true, the amplifier function 85 is enabled to perform its normal operation. However, when the signal 407 becomes false, the amplifier function 85 is conventionally inhibited in such a manner as to force the governor valve reference setpoint output 86 to a value to keep the governor valve hydraulic servo systems 87 maintaining the governor valves in a closed position.

In operation, it is understood that the governor valves and interceptor valves will still be hydraulically rapidly closed upon the occurrence of the overspeed protection control demand signal 100. In addition, switches 307 and 308 are controlled open as a result of the overspeed protection control demand signal 100. The switch 307 will be controlled closed to reconnect the control signal developed by controller 305 to the buffer amplifier 310 as a result of each of the dump valves 151 being deactivated. The setpoint references of the interceptor valve hydraulic servo systems 93 are now controlled in accordance with the speed error generated by the summing function 301 using the control function 305. In this embodiment, the control function 305 may be any one of a proportional controller, a proportional-plus-integral controller or a proportional-plus-integral-plus-derivative controller, as the case may be. The interceptor valves will continue to control the turbine speed at approximately a value equal to the synchronous speed using the trapped steam energy of the reheater.

During this speed control period, the governor valves will be maintained closed by the disabling signal 407. Should the speed control using the interceptor valves be maintained until the speed energy of the reheater is dissipated and the interceptor valves approach a position in which they can no longer effectively admit steam to the lower pressure turbines to control the rotating speed of the turbine system, the governor valves are then enabled by signal 407 according to the logic of FIG. 8 to admit steam to the higher pressure turbine section to control the turbine speed. The functional schematic as shown in FIG. 8 is provided to detect such a situation. When the measured speed SPD falls below the synchronous speed value by more than, say for example, 5 RPM, the output of the comparator circuit 401 becomes true. Likewise, if the aggregate of the interceptor valve position signals becomes greater than the threshold setting of the comparator 405 typically set at 20%, the output of the comparator 405 also becomes true. When these two conditions exist concurrently, the AND gate 403 responds by setting its output 407 true which then conventionally enables the operation of positioning the governor valves through amplification function 85 in accordance with the speed error developed within the speed controller 36. The positioning of the governor valves is then the primary source in controlling the speed of the turbine at synchronous speed. The interceptor valves are primarily operating in their wide open position state.

When it is desired to resynchronize (reconnect) the turbine power system to the power system load, the main generator breaker 30 is closed. This condition is detected by the logical signals 408 and 409 as shown in FIG. 7. The logical signal 408 is rendered true and controls the SPST switch function 326 to a closed position allowing clock pulses from the clock 324 to increment the counter 322 to a full count. Also, the condition of the breaker closing renders a false signal to one input of the AND gate 410 to disable the signal which is used to hold the SPST switch function 320 open, thus allowing the signal resulting from the D-A converter 318 to be conducted to the input of the amplifier function 310. In this state, the counter 322 is ramped up to a full count which is representative of a wide open demand signal for the interceptor valves. This counter demand signal is converted by the digital-to-analog converter 318 and supplied as signal 316 to the buffer amplifier 310 through switch 320. The signal 316 overrides the speed control signal from the speed controller 305 to force the interceptor valve setpoint references to a wide open demand state. Thus, during load control, the interceptor valves will be maintained in their wide open positions to prevent enthalpy losses from occurring thereacross.

This alternate embodiment of the speed control function as described in connection with FIGS. 7 and 8 may be inhibited from performing its operations either by an operator through depression of the push button PBI or as a result of detection of a turbine trip over signal line 314. In either case, the inhibit speed control signal ISC is triggered in accordance with the operation of the flip-flop 312 and controls the switch 308 in the open position using signal line 313 thereby breaking the connection of the control signal from controller 305 to the setpoint references of the interceptor valves.

We claim:

1. In a steam turbine system comprising an electrical generator; a steam turbine including a high pressure and at least one lower pressure turbine sections operative at a first predetermined rotating speed for providing mechanical power to said electrical generator which converts the mechanical power to electrical power which is supplied to a power system load; a source of steam; at least one governor valve operative to control the admission of steam from said steam source to said high pressure turbine section; a reheater coupled between said high pressure and at least one lower pressure turbine sections for heating steam conducted therethrough to said at least one lower pressure turbine section; at least one interceptor valve operative to control the admission of steam from said reheater to said at least one lower pressure turbine section; a main generator breaker operative in a closed position for electrically connecting said generator to said power system load and operative in an open position for electrically interrupting the flow of electrical power to said power system load; and a control means for controlling the amount of said electrical power supplied to said power system load at times when said breaker is closed, a controller for protecting the steam turbine against an overspeed condition primarily occurring as a result of said main generator breaker opening and interrupting electrical power flow to said power system load, said overspeed protection controller comprising the combination of:

means for generating a first signal in real time representative of the actual rotating speed of said turbine;

electrohydraulic means operative to rapidly close each of said governor and interceptor valves, said electrohydraulic means being activated by one of either a detection of said breaker opening during a time when generated electrical power is greater than a predetermined value of electrical power or the detection of said first signal being greater than a second predetermined rotating speed value, whereby steam flow admitted to said turbine sections is interrupted and steam energy is trapped in said reheater, said electrohydraulic means being deactivated at a time which is subsequent to a predetermined time interval immediately following the detection of said breaker opening when said first signal is no longer greater than said second predetermined rotating speed value; and means operative in response to the deactivation of said electrohydraulic means to control the rotating speed of said steam turbine by positioning the interceptor valves to admit steam to said at least one lower pressure turbine section in accordance with a continuous function based on the difference between said first signal and a value representative of said first predetermined rotating speed, whereby the trapped steam energy in said reheater is utilized for keeping said steam turbine at said first predetermined rotating speed to permit rapid reconnection of said turbine system to said power system load.

2. The overspeed protection controller in accordance with claim 1:

wherein each of said interceptor valves is positioned by an electrohydraulically operated servo system having a setpoint provided by said rotating speed control means and a feedback signal correspondingly representative of the position of the valve associated therewith; and wherein said electrohydraulic means includes a dump valve and a solenoid valve cooperating therewith for each interceptor valve, said solenoid valve when energized renders said dump valves activated to concurrently disable the operation of said servo systems and rapidly close the interceptor valves correspondingly associated therewith and when deenergized renders said dump valves deactivated to enable the operation of each servo system to reposition the interceptor valves according to said setpoints provided thereto.

3. The overspeed protection controller in accordance with claim 2 wherein each feedback signal of each servo system is a characterized valve flow signal based on a signal representative of the actual valve position and the setpoint of each servo system is a valve flow demand signal.

4. The overspeed protection controller in accordance with claim 1 wherein the first predetermined rotating speed is substantially proportional to the frequency of the power system load.

5. The overspeed protection controller in accordance with claim 1 wherein the second predetermined rotating speed is substantially equivalent to 103% of the first predetermined rotating speed.

6. The overspeed protection controller in accordance with claim 1 wherein the predetermined value of electrical power is equivalent to approximately 30% of the rated electrical power output of the turbine system associated therewith.

7. The overspeed protection controller in accordance with claim 1 wherein the predetermined time interval is adjustable within the range of 1 to 10 seconds.

8. The overspeed protection controller in accordance with claim 1 wherein the continuous function of the speed controlling means is a proportional controller governed by said speed error between said first signal and the value representative of said first predetermined rotating speed to position the interceptor valves.

9. The overspeed protection controller in accordance with claim 1 wherein the governor valve positions are concurrently proportionally controlled by the rotating speed control means in accordance with the same continuous function.

10. The overspeed protection controller in accordance with claim 1 wherein the rotating speed control means may be inhibited from controlling the speed of the turbine subsequent to the opening of the breaker during electrical load generation to the power system load.

* * * * *